United States Patent [19]

Honeycutt, III

[11] Patent Number: 4,945,974

[45] **Date of Patent: * Aug. 7, 1990**

[54] APPARATUS FOR AND PROCESS OF DIRECT CASTING OF METAL STRIP

[75] Inventor: LeRoy Honeycutt, III, Salisbury, N.C.

[73] Assignee: Reynolds Metals Company, Richmond, Va.

[ * ] Notice: The portion of the term of this patent subsequent to Jan. 30, 2007 has been disclaimed.

[21] Appl. No.: 323,028

[22] Filed: Mar. 14, 1989

Related U.S. Application Data

[63] Continuation-in-part of Ser. No. 152,486, Feb. 5, 1988, abandoned.

[51] Int. Cl.[5] ..... B22D 11/06

[52] U.S. Cl. ..... 164/479; 164/480; 164/428; 164/429

[58] Field of Search ..... 164/428, 429, 480, 479

[56] References Cited

U.S. PATENT DOCUMENTS

| | | | |
|---|---|---|---|
| 3,345,738 | 10/1967 | Mizikar et al. . | |
| 3,431,971 | 3/1969 | Gyöngyös . | |
| 3,871,439 | 3/1975 | Maringer et al. | 164/37 |
| 4,250,950 | 2/1981 | Buxmann et al. | 164/430 |
| 4,489,772 | 12/1984 | McLane et al. | 164/423 |
| 4,715,428 | 12/1987 | Johns et al. | 164/463 |
| 4,749,024 | 6/1988 | Bartlett et al. | 164/463 |
| 4,751,957 | 10/1988 | Vaught | 164/463 |

FOREIGN PATENT DOCUMENTS

| | | |
|---|---|---|
| 0147912 | 7/1985 | European Pat. Off. . |
| 59-13551 | 1/1984 | Japan . |
| 50-35220 | 8/1985 | Japan . |
| 626725 | 4/1981 | Switzerland . |

*Primary Examiner*—Kuang Y. Lin

*Attorney, Agent, or Firm*—Lowe, Price, LeBlanc, Becker & Shur

[57] ABSTRACT

A melt drag metal strip casting system of the type wherein molten metal is delivered from a supply of the molten metal into contact with a grooved chill surface at a casting station and the chill surface is driven for movement in a path past the casting station at a predetermined linear rate to quench and withdraw a continuous strip of metal from the molten metal supply, the grooves in the chill surface being gradually parallel and spaced from one another to provide land regions between adjacent grooves and the strip having a bottom surface adhering to the land regions of the chill surface and an unsolidified top surface as it is withdrawn from the molten metal supply, including a top roll adjustable mounted above the chill surface and spaced therefrom by a distance substantially equal to the thickness of the strip desired with the top roll in contact only with the unsolidified top surface of the strip, with the temperature of the top roll surface in contact with the unsolidified top surface of the strip being maintained at a level which will not solidify the top surface of the metal being cast.

20 Claims, 3 Drawing Sheets

APPARATUS FOR AND PROCESS OF DIRECT CASTING OF METAL STRIP

This is a continuation-in-part of copending application Ser. No. 152,486, filed Feb. 5, 1988, now abandoned.

BACKGROUND OF THE INVENTION

1. Field of the Invention

This invention relates to continuous direct casting of metal strip by a process employing a moving chill surface upon which molten metal is flowed for solidification beginning on the chill surface and progressing in a direction outwardly to the free top surface of the strip formed.

2. Prior Art

The advantages to be achieved in direct casting of molten metal into thin strip or sheet (hereinafter strip) on a continuous basis have long been recognized and numerous processes and devices have been proposed for the direct casting of metal strip. These prior art processes or devices have generally not been successfully employed on a commercial basis, however, particularly for the production of a high quality strip suitable for use in the as-cast condition for the production of commercial products, or for further processing as by rolling or shaping by other means.

In the known prior art continuous or direct strip casting processes employing a continuOusly driven liquid cooled chill surface which contacts a melt of the metal to be cast, the melt is solidified by extracting heat through the chill surface so that a thin skin of the metal is solidified immediately upon contact with the chill. This skin grows in thickness as the chill moves progressively through or past the melt until the strip is completely formed. The thin skin initially formed is firmly adhered to the chill and this intimate bonded contact results in a maximum heat transfer from the melt to the chill. This process is generally referred to as a melt drag process.

The extraction of heat from the progressively formed strip results in contraction of the solidifying strip at its bonded interface with the chill until the bond is broken, thereby producing a substantial reduction in the rate of heat extraction. The successful production of quality cast strip by such a process depends to a large degree upon the ability to extract heat at a uniform rate across the width of the strip to produce a substantially simultaneous release of the cast product from the chill across the full width of the strip.

Uneven or premature release of the forming strip and areas of uneven contact with the chill can result in localized surface defects. These surface defects may be manifested as discoloration, cracking, texture variation, surface porosity, thickness variations, and dimpling, some of which defects may appear on either or both surfaces of the strip. One cause of localized surface defects has been attributed to gases either evolving or entrained between the strip and chill, which gases expand and cause localized premature release.

The problem of localized uneven contact or premature release as a result of gases between the strip and chill surfaces has been largely solved by use of a grooved chill surface which provides continuous, unobstructed escape passages for any such gases. The size and configuration of the individual grooves is such that the melt does not penetrate to the root, leaving a gas escape passage at each groove. The spacing of the grooves is such that only a narrow band of the chill surface between adjacent grooves is in direct contact with the forming strip, thereby eliminating the possibility of entrapment of sufficient gas to cause premature release over an area sufficiently large to materially affect the cooling rate.

Defects which are not associated with localized premature strip release also frequently occur in the top surface of the strip, i.e., the surface away from the chill. These defects may include surface cracks as well as variations in gauge longitudinally of the strip and variations in transverse profile, making subsequent rolling or other processing of the cast strip difficult or impossible. Attempts have been made to control profile and gauge variations by contacting the unsolidified top surface of the strip with a second chill roll. Such cooled top rolls cool and solidify the top surface or skin of the strip and act as a flow controller to limit the amount of molten metal deposited upon the chill.

It is also known to contact the top surface with a pressure roll immediately after solidification of the strip in an attempt to control the strip gauge by a hot rolling action. Such pressure rolls have been internally cooled or otherwise configured to dissipate heat and provide a chilling effect on the strip.

Difficulty has been encountered in attempting to use a top roll of the type disclosed in the prior art in contact with the formed or forming strip moving on a primary chill surface. For example, when a cooled top roll is employed in contact with molten metal, there is a tendency for the top surface to solidify on contact with the chilled surface and to adhere to the surface in the same manner as the bottom strip surface adheres to the primary chill. Although this bond between the top strip surface and the cooled top roll may be only brief and broken more readily as a result of the relatively small radius of the top roll, cast sheet defects can nevertheless result.

Difficulty has also been encountered in attempting to form directly cast thin metal strip using a top roll engaging and hot rolling the top surface after solidification. Although the strip is still extremely hot and soft when contacted with the top shaping roll, metal movement in such a rolling operation can essentially only be in the rolling direction, i.e., longitudinally of the formed strip, and therefore corrections of the transverse profile of the strip cannot be accomplished. Further, any surface defects of the type described above will be formed before the strip reaches the top roll, making rolling difficult or impossible. Also, hot rolling can result in propagating surface cracks rather than eliminating them.

Attempts to shape the strip cast on a grooved chill surface by a hot rolling operation immediately following solidification on the chill also results in forcing of the bottom surface of the soft strip into any grooves or other surface depressions employed on the chill surface. This results in the grooved pattern of the chill being replicated on the bottom surface of the strip which can present problems in subsequent rolling or processing operations. Pressing the strip into the chill surface grooves also promotes non-uniform release and sticking or transverse tearing of the still soft strip.

It is, accordingly, a primary object of the present invention to provide a novel process of and apparatus for producing directly cast thin metal strip in a high speed commercial operation.

Another object is to provide such a process and apparatus to produce a directly cast thin metal strip having an improved transverse profile and more uniform longitudinal shape.

Another object of the invention is to provide such a process and apparatus having a smooth uniform top surface substantially free from transverse cracks.

Another object is to provide such a process and apparatus wherein thin, wide metal strip is directly cast on a grooved chill surface in a melt drag casting operation with an uncooled or heated top roll engaging the unsolidified top surface of the strip being formed to provide a strip of more uniform gauge and profile and having a top surface which is substantially smooth and free of transverse cracks.

SUMMARY OF THE INVENTION

The foregoing and other features and advantages are achieved in accordance with the present invention wherein a melt of the metal to be cast is brought into contact with a continuously moving chill having a grooved chill surface to solidify a strip of substantially uniform thickness on the chill surface and is removed after solidification is substantially complete. The chill may be an internally cooled cylindrical casting wheel and the process will be described herein with specific reference to apparatus using such a casting wheel, it being understood that other chill configurations may also be employed.

The preferred embodiment of the invention described in detail hereinbelow employs a casting wheel having a grooved chill surface positioned to effectively form one end wall of a tundish or other container for a melt of the metal to be cast and rotated in a direction to move the chill surface upwardly through and out of the melt.

As the continuous surface of the chill moves into contact with the molten metal in the tundish, a thin solid skin of metal immediately forms on and firmly adheres to the chill, with the thickness of this skin progressively increasing as it moves with the chill upwardly through the melt. An uncooled top roll is positioned to have its surface in fixed spaced relation to the surface of the chill and supported for rotation about an axis parallel to the axis of the driven casting wheel. The top roll is positioned to engage liquid metal moving with the top of the solidified portion of the strip while avoiding any contact with the solidified portion of the strip, and preferably only a thin layer or film of molten metal passes beneath the top roll. The top roll may be shaped to produce the desired cross sectional dimensions for the strip being formed. The top surface of the strip is unconfined and exposed to the air or other gaseous atmosphere downstream of the top roll.

The top roll is uncooled and preferably is maintained at an elevated temperature to avoid both solidification of the strip top surface and pressing the bottom surface into the chill surface grooves. This assures freedom of the film of molten metal passing beneath the top roll to move both longitudinally and transversely of the moving strip to produce a uniform, smooth top surface defined by the liquid film exiting the nip of the top roll. The film of liquid metal also avoids the application of pressure to the solidified portion of the strip without further movement relative to the strip and results in a more uniform strip having a top surface sufficiently free of cracks and other defects for commercial use in the as-cast condition and for further processing.

BRIEF DESCRIPTION OF THE DRAWINGS

The foregoing and other features and advantages of the present invention will be apparent from the detailed description contained hereinbelow, taken in conjunction with the accompanying drawings, in which.

DESCRIPTION OF THE PREFERRED EMBODIMENT

Figure 1:
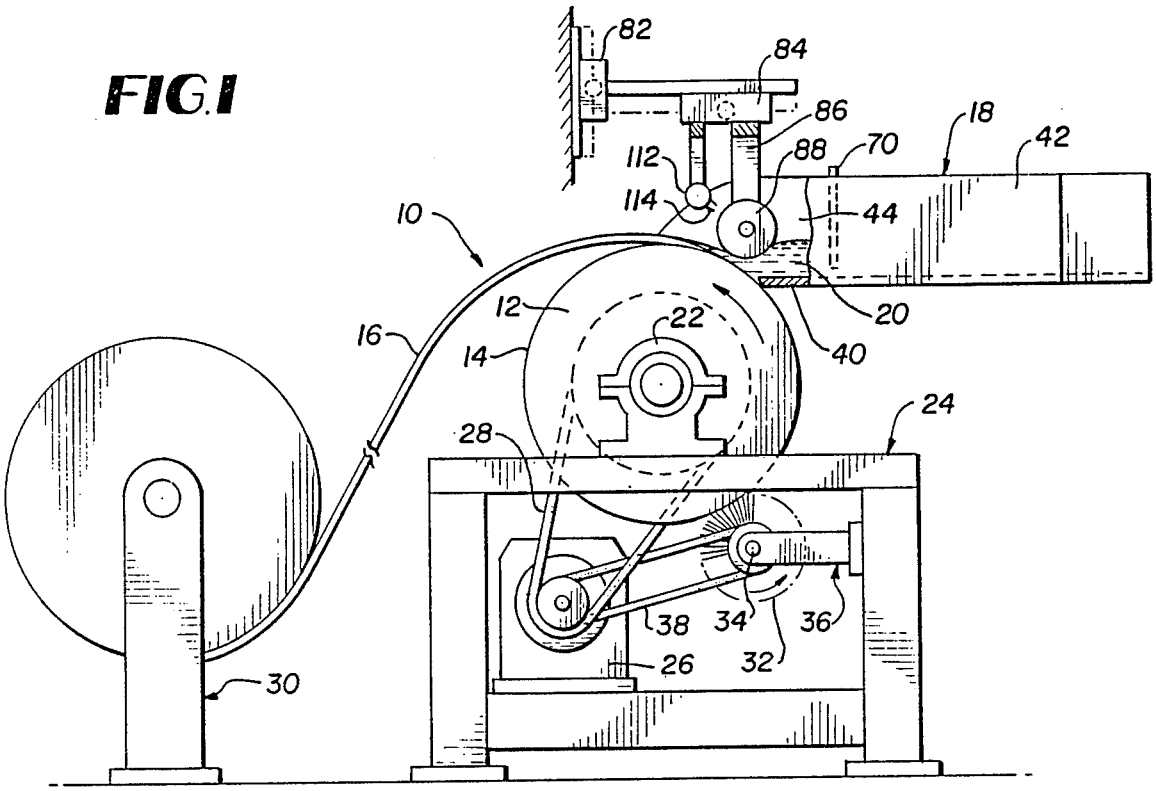
FIG. 1 is a schematic view, in elevation and partially in section, of a direct strip casting apparatus embodying the principles of the present invention.

Casting wheel 12 is internally cooled with circulating water or other cooling fluid which rapidly extracts heat through surface 14 to thereby quench and solidify liquid metal from the melt 20 as the casting surface 14 rotates upwardly through the melt in tundish 18. Internally cooled casting wheels are known and as such wheel 12 forms no part of the present invention. One example of a known internally cooled casting wheel is found in U.S. Pat. No. 2,348,178. Also, as described more fully hereinbelow, the outer surface 14 of the chill 12 is provided with a plurality of shallow, closely spaced grooves 21 more clearly seen in FIGS. 8 and 9.

Suitable means such as journal bearings 22 support the chill 12 for rotation about a fixed horizontal axis on a rigid support frame indicated generally by the reference numeral 24. The chill is supported in close proximity to tundish 18, and suitable drive means such as a variable speed motor and reduction gear mechanism 26 and a drive chain or belt 28 illustrated schematically in FIG. 1 are provided to drive the chill about its fixed horizontal axis. A suitable coiling assembly of conventional design, illustrated schematically at 30, may be provided to continuously coil the strip 16 as it is discharged from the continuous casting assembly.

In order to maintain a uniform, polished, dense natural oxide coating on the chill surface 14, a rotary brush 32 is mounted for rotation on a shaft 34 with its longitudinal axis parallel to the axis of rotation of the wheel 12. Brush 32 is supported by suitable brackets 36 and driven, as by belt 38, from motor and reduction gear assembly 26 to continuously engage and polish the surface 14. The brush assembly, and the polishing effect to maintain the uniform oxide coating on the surface 14 are described in detail in copending U.S. patent application Ser. No. 07/263,074, filed Oct. 27, 1988 and assigned to the assignee of the present invention.

Figure 2:
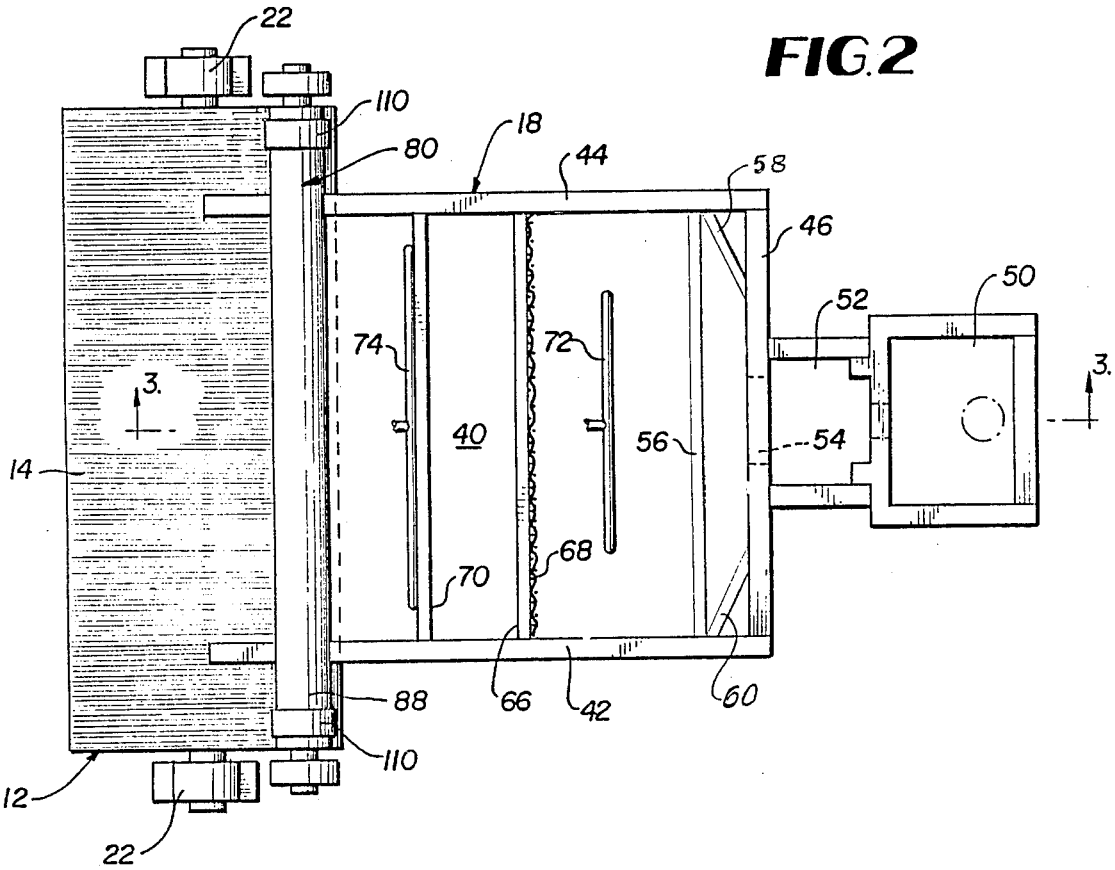
FIG. 2 is a plan view of a portion of the apparatus shown in FIG. 1.
Figure 3:
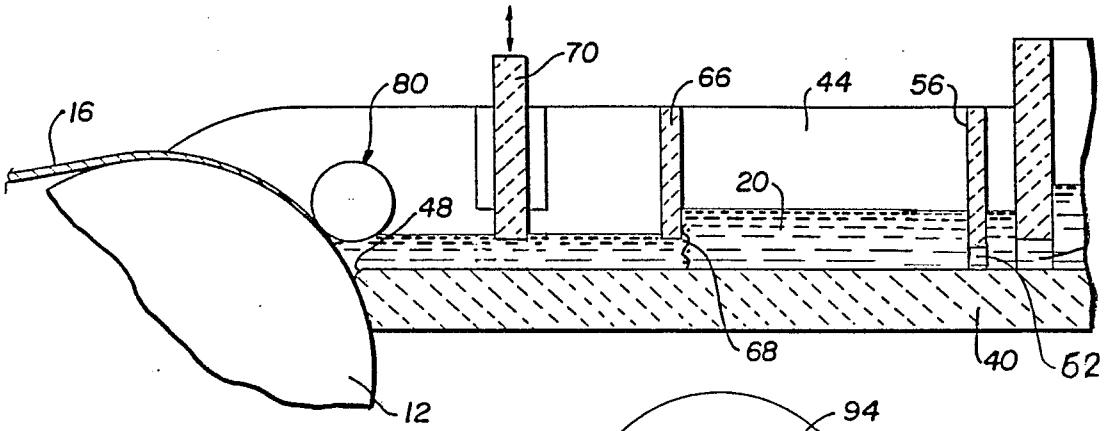
FIG. 3 is an elevation view, partially in section, taken along line 3—3 of FIG. 2.

As best seen in FIGS. 2 and 3, the tundish assembly 18 includes a floor 40 and laterally spaced, upwardly extending sidewalls 42, 44, a rear end wall 46 and an open exit end effectively closed by chill surface 14. Bottom wall 40 terminates at the open end of the tundish in a contoured lip 48 best seen in FIGS. 3 and 7. Molten metal is supplied to the tundish 18 from a receiving chamber 50 and level equalizing chamber 52 through a submerged inlet port 54 in end wall 46. Molten metal may be supplied to the receiving chamber 50 by any suitable means such as a ladle or a hot metal transfer system from a melting furnace.

Molten metal flowing into the tundish 18 through inlet opening 54 engages a flow distribution wall 56 which has a plurality of submerged metering orifices 62 formed therein adjacent to the bottom wall 40 and spaced across the width of the tundish. In order to eliminate stagnant flow areas in the rear corner portions of the tundish, a pair of diagonal walls 58, 60 extend between end wall 46 and sidewalls 42, 44 respectively, with the walls 58, 60 extending in outwardly diverging relation from the end wall 46.

A transverse dam or wall 66 extends between sidewalls 42 and 44 at a position downstream of the distribution member 56. Divider wall 66 has its bottom edge spaced above the top surface of bottom wall 40 and a submerged flow diffuser screen or filter 68 extends between the wall 66 and the bottom of the tundish to provide further flow equalization and distribution of the molten metal. A movable flow control gate 70 is supported for vertical sliding movement in tundish 18 at a location between the divider wall 66 and lip 48 as best seen in FIG. 3. Gate 70 is guided in suitable channels on the inner surface of walls 42, 44 for movement between a raised casting position permitting free flow of melt to the chill surface and a lowered position in contact with the top surface of bottom wall 40. Gate 70 preferably has its bottom edge positioned slightly below the melt surface in the casting position to act as a final skimmer. If desired, as when casting highly reactive or easily oxidizable metals, a removable hood or cover (not shown) may be provided above the open top of the tundish and an atmosphere of inert gas such as nitrogen or argon supplied beneath the hood. For this purpose, a pair of gas distribution manifolds 72 and 74 may be provided in the tundish as shown in FIG. 2.

Figure 8:
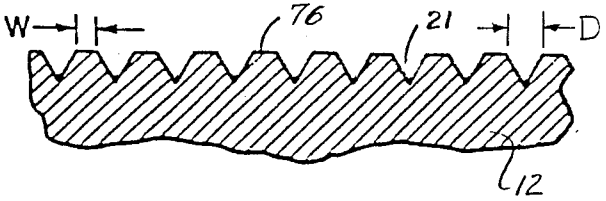
FIG. 8 is an enlarged fragmentary sectional view of a portion of the grooved casting wheel surface.
Figure 9:
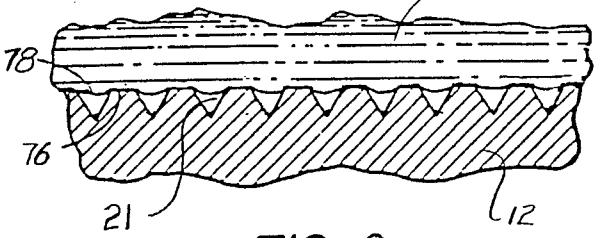
FIG. 9 is a representation of the liquid metal behavior at the surface in contact with the grooved surface shown in FIG. 8.

Referring to FIGS. 8 and 9, the grooves 21 formed in the outer surface of casting wheel 12 are preferably shallow V-shaped grooves having a short radius at the root and may be formed by conventional machining or rolling operations. The grooving may consist of a plurality of annular grooves or a single screw thread type helical groove. Since casting wheel 12 is of relatively large diameter, the total effect of a continuous low pitch helical groove will be the same as a plurality of concentric circular grooves.

Adjacent grooves 21 in the surface 14 are spaced apart to provide a smooth cylindrical surface or land 76 of finite width W therebetween. The pitch of the grooves, whether concentric grooves or consecutive turns of a helical groove, should provide a groove density of from about 12 to about 35, and preferably about 15 to 25 grooves per centimeter measured axially of the casting wheel and be uniform over the entire casting surface. The ratio of the width W of the lands to the distance D between adjacent lands should be within the range of about 0.15 to about 0.75, although higher ratios may be useful in casting some metals and for some casting speeds. Also, although V-shaped grooving is not essential, it is preferred, with the root angle preferably being within the range of about 30° to 70° and the depth of the grooves being within the range of about 0.025–0.2 millimeters.

In accordance with the present invention, a top roll assembly 80 is supported for rotation about a horizontal axis parallel to the axis of casting wheel 12 at a location near the top surface of the molten metal 20 in the tundish and the point of emergence from the melt of the strip of metal being cast during the casting operation. Mounting means is provided for supporting the top roll assembly for adjustment vertically and horizontally to adjust the axis of the roll 80 relative to the parallel axis of the wheel 12. The adjustable mounting means for roll 80 is illustrated schematically in FIG. 1 as including a first slider block 82 mounted for rack and pinion adjustment in a vertical direction and a second slider block 84 supported for rack and pinion adjustment in a horizontal direction. A rigid bracket assembly 86 mounted on and projecting downwardly from slider block 84 journals the ends of roll assembly 80 for free rotation about its horizontal axis.

Figure 4:
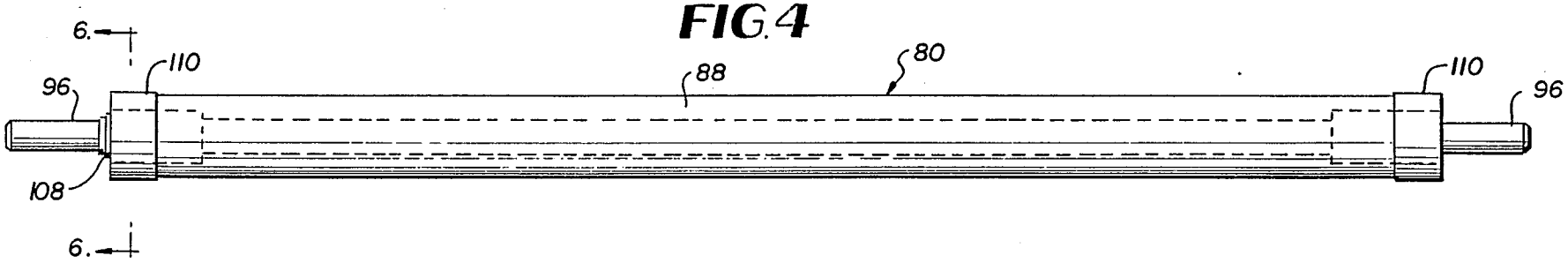
FIG. 4 is an elevation view of a top roll used with the apparatus of the present invention.
Figure 5:
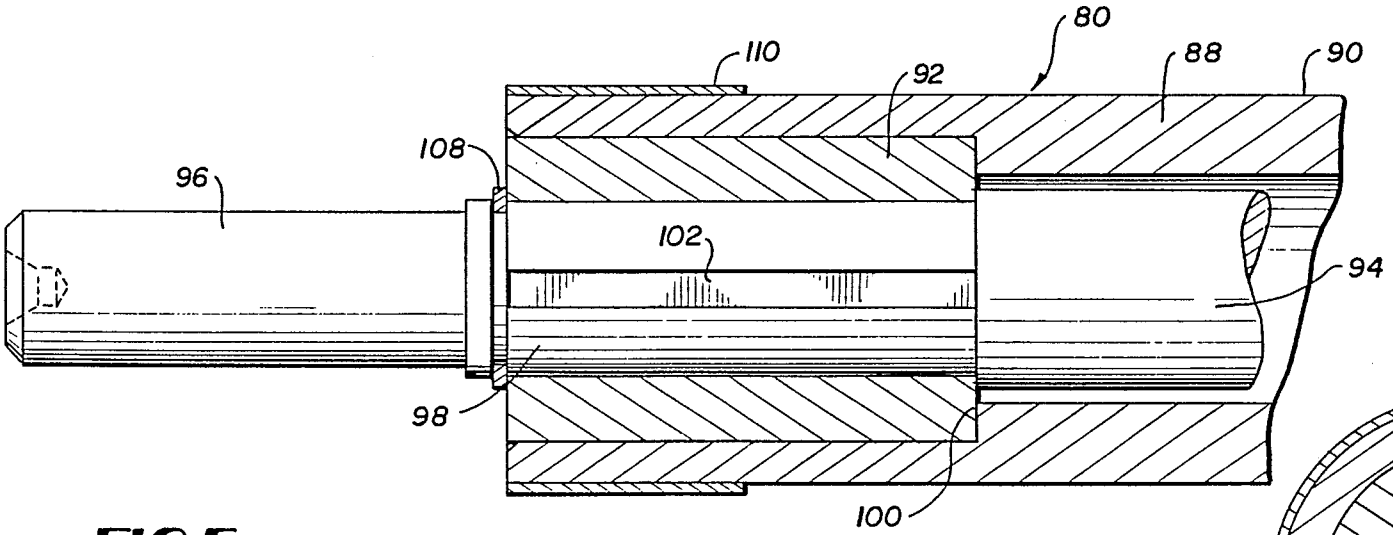
FIG. 5 is a sectional view, on an enlarged scale, of a portion of the roll shown in FIG. 4.
Figure 6:
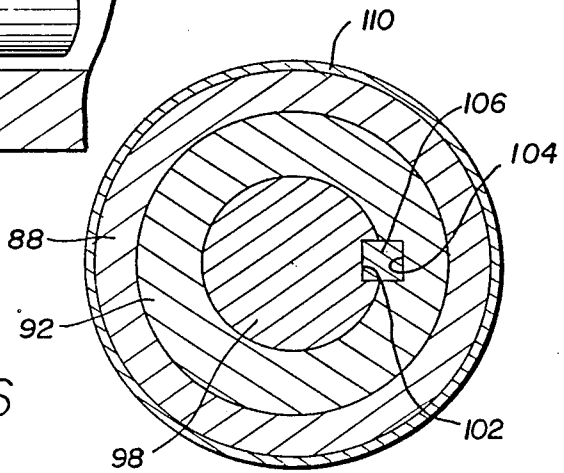
FIG. 6 is an enlarged sectional view taken along lines 6—6 of FIG. 4.

Referring to FIGS. 4, 5 and 6, a roll assembly which has been successfully used in practicing the present invention will be described in detail. As shown, the roll assembly 80 includes an elongated cylindrical tubular sleeve 88 having a smooth outer surface 90 for contacting molten metal moving with the strip being cast in the manner described more fully hereinbelow. Tubular sleeve 88 is provided with a counterbore at each end, forming a seat for receiving a short cylindrical bushing member 92, only one of which is shown in FIG. 4, it being understood that the other end of the roll assembly may be substantially identical to the end portion shown in FIG. 4.

The sleeve 88 and bushings 92 are supported on and keyed to an elongated shaft 94 for rotation therewith. Shaft 94 is provided with a reduced diameter bearing portion 96 adjacent each end, an intermediate diameter bushing support portion 98 spaced inwardly from the bearing sections 96, and a central portion of maximum diameter. A shoulder 100 at the juncture of the bushing support portion and central portion is adapted to engage the end of the bushings 92 when the bushings are installed in the sleeve 88 to axially fix the sleeve on the shaft. An elongated keyway 102 formed in the bushing support portion 96 and a corresponding elongated keyway in the bushings 92 cooperate to receive a key 106 (see FIG. 6) to fix the bushings 92 on the shaft 94 for rotation therewith.

Bushings 92 are permanently joined by a suitable high temperature bonding agent or other suitable means to the inner surface of the counterbore in the sleeve 88 so that the complete assembly rotates as a unit. One of the bushings 92 may be bonded in the end of sleeve 88 prior to assembly, with the second bushing 92 being inserted and bonded after assembly with the shaft 94. A suitable retaining ring 108 may be provided in position to engage the exposed end of the bushing 92 to permit handling of the assembly until bonding of the bushing and sleeve is completed.

Once the roll assembly 80 is completed, the outwardly projecting bearing sections 96 of shaft 94 are mounted in suitable bearings on the bracket 86, and the bracket is adjusted to accurately position the roll relative to the chill surface 14. The roll may be supported for free rotation or driven in the same rotational direction on the chill 12, but preferably is driven in a direction opposite to the chill. Also, the top roll will normally be driven at a rate such that the surface speed of chill surface 14 and roll surface 90 are substantially equal although different surface speeds may also be employed.

The top roll may be driven by various means, including providing a drive chain or belt engaging a suitable sprocket or pulley on the end of shaft 94, but in the preferred embodiment illustrated in FIG. 4, the top roll 80 is driven directly from the chill 12. To accomplish this, a thin annular metallic band or sleeve 110 is mounted, as by a shrink fit or bonding, on each end portion of the tubular sleeve 88. The radial thickness of the sleeve 110 is selected to correspond to the desired spacing between the surface 90 and chill surface 14 as described more fully hereinbelow. In this embodiment, the top roll is adjusted to urge the outer surface of the sleeves 110 into contact with the outer surface of the chill 12 with sufficient force so that rotation of the chill will drive the roll 80 through frictional contact with the sleeves 110.

As discussed above, it is critical to the present invention that the top roll not be cooled for the extraction of heat from the top surface of the strip being formed. Instead, successful operation in accordance with this invention requires contact of the top roll with liquid metal only, both from the standpoint of providing the desired substantially defect-free top surface and of avoiding pressing the still soft bottom surface of the strip against the grooved casting surface. This is accomplished by maintaining the top roll at a temperature which will not sufficiently cool the liquid metal which it contacts to solidify the top surface of the forming strip.

The top roll may be maintained at the desired elevated temperature by contact with the molten metal alone or with the application of heat from an external source. Preferably, it is preheated to the desired temperature before commencing the process. Its operating temperature will vary with numerous factors including the thermal conductivity of the material from which it is made, the time of contact with the molten metal, and the temperature of the molten metal at the point of contact with the top roll. Preferably, however, the top roll surface will be maintained at a temperature which is at least substantially as high as the minimum solidification temperature of the metal or alloy being cast.

To avoid disruption of the strip top surface, the top roll should be formed from a material, or provided with a coating, which will not be wet by the molten metal to avoid a tendency of the molten metal. One roll which has been successfully used employs a graphite outer sleeve 88 as described above, but a solid graphite cylinder may also be employed as a top roll.

In order to assure against the molten metal sticking to the top roll, a suitable release agent may be applied to the roll surface. In operation with a graphite roll, carbon black, or soot, has been applied by directing a stream of partially combusted hydrocarbon gas such as acetylene onto the roll surface to deposit a thin coating of soot onto the roll on a continuous basis during casting. Such an arrangement is illustrated schematically in FIG. 1 and includes a manifold 112 extending substantially along the full length of the top roll in the area to be contacted with molten metal, and a burner nozzle, or series of nozzles 114 along the manifold 112 for directing a flow of combustible gas for combustion in contact with the roll surface 90. The gas may be selected to burn with a temperature to stabilize and maintain the surface temperature of the roll at the desired level while at the same time depositing a thin layer of carbon black to act as a release agent. Alternatively, separate burners may be employed to apply heat and coat the top roll, or the roll may be internally heated.

In order to initiate operation of the apparatus just described, it is possible to elevate the surface temperature of the roll 80 by contact with molten metal in the tundish until the necessary heat is absorbed, but this method may result in the production of strip of inferior quality until the top roll reaches the desired elevated temperature. Accordingly, a preferred method of operation is to preheat the top roll to the necessary minimum temperature before commencing the casting operation.

Figure 7:
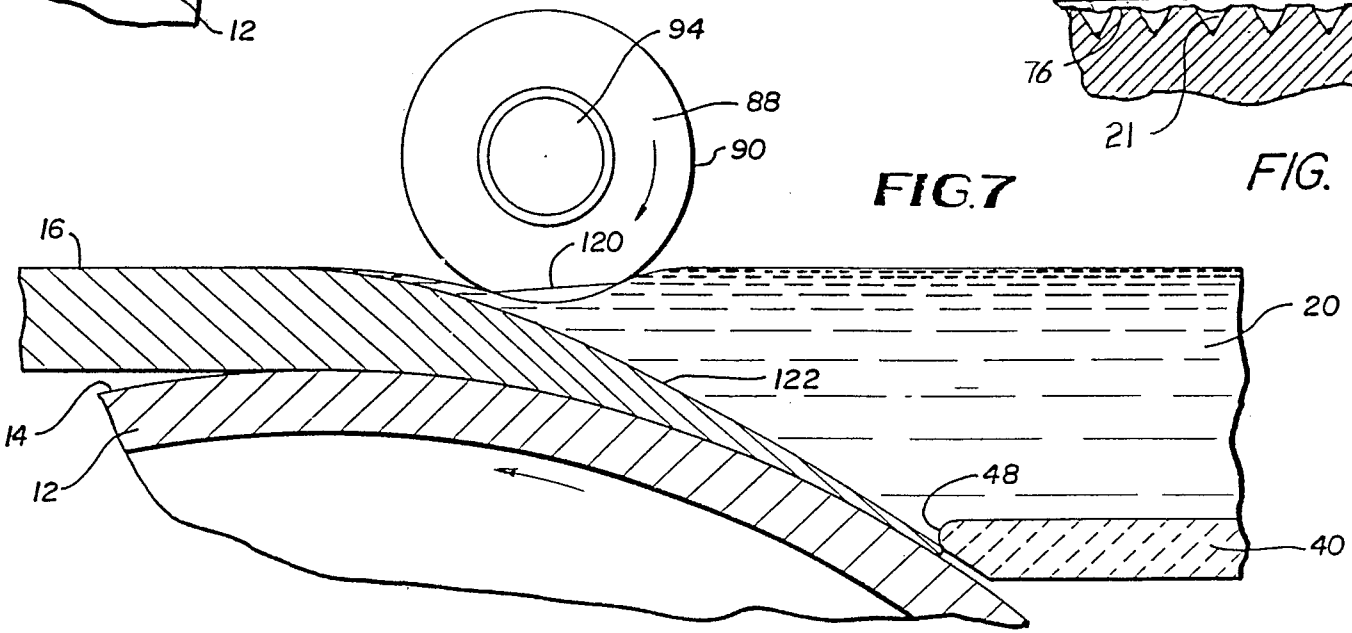
FIG. 7 is a diagrammatic showing, in section, of the flow of molten metal through the apparatus when practicing the present invention.

Operation of the direct casting apparatus and process provided by the present invention may be more fully understood from FIGS. 7–9 of the drawings. FIG. 7 is a diagrammatic showing of the interrelationship of the grooved casting surface 14, the tundish 18 and the top roll 80. As background, the system of FIG. 7 with the top roll 80 out of contact with molten metal from the tundish, would operate in accordance with the teachings of the prior art. In particular, movement of surface 14 in contact with a stream of molten metal from the tundish would effect immediate solidification of a thin film of the metal on the land areas 76 of chill surface 14. The surface tension and viscosity of the molten metal 20, and the close spacing of adjacent land areas 76, cause the melt to span each groove while being depressed in a shallow inverted arch or meniscus 78 into the groove space. Solidification of the strip thus progresses from the lands both upwardly toward the top strip surface and laterally across the portion of the bottom surface spanning the grooves. Solidification of the strip is complete shortly after it emerges from the melt 20 in the tundish 18.

Photomicrographs of aluminum alloy 3105 strip cast on a grooved casting wheel of the type described show that the strip has a unique grain structure. This unique grain structure is produced as a result of nucleation commencing at points along spaced parallel lines at the intersection of the casting wheel land surfaces 76 with the adjacent side surfaces of grooves 21. Grain orientation in the formed strip shows that growth progressed from the nucleation points across the area of the strip spanning the grooves and across the area spanning the lands. The grain size in the area spanning the grooves is larger than in the area spanning the lands, and this unique pattern of grain size and orientation is highly uniform throughout the formed strip.

It has been found that the unique grain structure of aluminum strip cast on a grooved casting surface of the type described without use of a top roll is also present in strip cast on a grooved casting surface while using an uncooled top roll in accordance with the present invention. Since there is always at least a film of liquid metal passing beneath the top roll, no significant pressure is transmitted to the solid portion of the forming strip, and consequently the strip is not forced into the grooves.

The use of an uncooled top roll in combination with a chill wheel having a grooved casting surface avoids the formation of ripples and transverse cracks and also aids in controlling shape, profile and thickness of cast strip while retaining the advantages obtained from the grooved casting surface alone. In practicing the present invention, the axis of rotation of the top roll 80 is positioned relative to the top surface of the melt 20 to provide a segment of the top roll surface defined by chord 120, which projects into the melt. Thus, upon rotation of the top roll, this portion of the external cylindrical surface of the roll moves in continuous relation with the molten metal facing the segment; such molten metal comprising molten metal ultimately forming the top surface of the cast strip. Also, the axis of rotation of the top roll is located to position the path of movement of the top roll surface in the liquid metal above the liquid-solid interface 122 and to locate the point of separation of the submerged surface portion and the liquid metal as close as practical to the point of total solidification of the strip while considering other requirements such as the desired thickness of the strip and avoiding any contact of the top roll with the solidified portion of the strip. The adjusted position of the axis of rotation of the top roll may be obtained by adjusting the rack and pinion arrangements discussed above.

During operation of the process the chill surface 14 will continue to extract heat and affect solidification of the molten metal until the strip is completely solidified. To preclude solidification of the top surface in the region of the submerged surface of the top roll 80 it is critical that the top roll be an uncooled roll or a heated roll. As used herein, the term "uncooled" is intended to mean a roll which is not cooled to extract heat from the melt, but which is operated at a temperature which will not solidify the top surface of the strip. Thus, the molten metal contacting the submerged section of the roll surface will emerge and separate from the top roll while still in the liquid state. During operation, this emerging top surface on the strip can be observed as a shiny liquid surface which quickly solidifies after separation from contact with the top roll.

It has been discovered that both longitudinal and lateral movement of molten metal is produced by action of the uncooled top roll to substantially eliminate ripples and transverse cracks in the top surface of the cast strip. Furthermore, it has been found that by permitting only a thin film of molten metal to pass beneath the top roll, this film is quickly solidified to provide more accurate control of the shape, profile and thickness of the cast strip.

The top roll may be contoured along its length to produce the desired gap between the top roll and the chill surface to thereby produce the desired strip cross sectional shape and to compensate for predetermined dimensional changes in the chill surface resulting from operational conditions. For example, depending on the intended use, it may be desirable to produce a strip with a uniform cross section or with a slight crown or increased thickness from the edges to the center.

While a preferred embodiment of the invention has been disclosed, it should be understood that the invention is not so limited but rather that it is intended to include all embodiments which would be apparent to one skilled in the art and which come within the spirit and scope of the invention.

What is claimed is:

1. In a melt drag metal strip casting apparatus wherein molten metal is delivered from a supply of the molten metal into contact with a chill surface at a casting station and the chill surface is driven for movement in a path past the casting station at a predetermined linear rate to quench and withdraw a continuous strip of metal from the molten metal supply, the strip having a bottom surface adhering to the chill surface and an unsolidified top surface as it is withdrawn from the molten metal supply, the improvement comprising, a plurality of generally parallel grooves formed in said chill surface, said grooves being spaced from one another to provide a finite, substantially smooth land region between each adjacent pair of said grooves, said grooves having a density of at least about 12 grooves per centimeter and having a width sufficiently small so that molten metal being cast forms a meniscus spanning each groove, a top roll, mounting means supporting the top roll for rotation about a horizontal axis above the chill surface with the top roll surface spaced from the chill surface by a distance substantially equal to the thickness of the strip desired and in position to contact only the unsolidified top surface of the strip whereby a strip being formed is not forced into said grooves, means independent of the metal being cast for applying heat to the top roll, means driving the top roll for rotation about its horizontal axis, and means withdrawing the solidified layer as a continuous metal strip.

2. Apparatus for direct casting of molten metal as defined in claim 1 in which the means for heating the top roll includes means for substantially continuously applying heat to the top roll during flow of the molten metal onto the chill surface.

3. Apparatus as defined in claim 1 further comprising means for rotating the top roll at a surface speed substantially equal to the speed of said chill surface.

4. Apparatus as defined in claim 1 wherein said top roll has an outer surface contoured to provide a substantially uniform gap between the top roll and the chill surface along the full width of the strip being cast.

5. Apparatus as defined in claim 1 wherein said top roll has an outer surface contoured to provide a non-uniform gap between the top roll and the chill surface along the width of the strip being cast.

6. Apparatus as defined in claim 1 wherein said chill surface comprises the substantially cylindrical external surface of an internally cooled casting wheel driven for rotation about a horizontal axis, said plurality of grooves comprising consecutive turns of a continuous generally V-shaped helical groove formed in said cylindrical surface, and wherein said means driving said top roll comprises means rotating said top roll about an axis parallel to the axis of said casting wheel in a direction opposite to the direction of rotation of said casting wheel and at a surface speed substantially equal to the surface speed of said chill surface.

7. Apparatus as defined in claim 6 wherein said groove density is within the range of about 15 to about 25 grooves per centimeter.

8. Apparatus as defined in claim 6 wherein the ratio of the width of said lands to the width of said grooves is within the range of about 0.15 to about 0.75.

9. Apparatus for direct casting of molten metal as defined in claim 8 further comprising means for applying heat to the surface of the top roll from an external source.

10. Apparatus as defined in claim 9 wherein said top roll comprises an elongated cylindrical body of graphite material defining the outer surface of the top roll which contacts the molten metal on the moving chill surface.

11. For use in a melt drag strip casting apparatus wherein molten metal is delivered from a supply of the molten metal into contact with a chill surface at a casting station and the chill surface is driven for movement in a path passed the casting station at a predetermined linear rate to quench and withdraw a continuous strip of metal from the molten metal supply, the strip having a bottom surface adhering to the chill surface and an unsolidified top surface as it is withdrawn from the molten metal supply, a top roll adapted to be mounted above the chill surface and spaced therefrom a distance substantially equal to the thickness of the strip desired for contact with the unsolidified top surface of the strip, said top roll including an elongated cylindrical graphite body having a smooth outer surface for engaging the unsolidified metal on the top surface of a metal strip emerging from a supply of molten metal, and means supporting said graphite body for rotation about a horizontal axis parallel to and spaced from the top surface of the metal strip.

12. Apparatus defined in claim 11 wherein said graphite body comprises an elongated hollow graphite sleeve, and wherein said means supporting said graphite body comprises metal shaft means projecting outwardly from the ends of said graphite sleeve to define bearing sections adapted to be supported in bearings, and means joining said sleeve and said shaft means for rotation together about a common axis.

13. The method of casting commercial quality metal sheet directly from molten metal in a melt pool in a tundish, comprising grooving the outer cylindrical surface of a chill wheel with axially spaced substantially circumferentially extending grooves to produce a casting surface with a uniform groove density within the range of from about 12 to about 35 grooves per centimeter and having smooth substantially cylindrical land regions between adjacent grooves with the substantially flat land regions intersecting the sides of adjacent grooves along generally circumferentially extending, axially spaced lines, rotating the chill wheel about a first axis and passing the grooved surface through the melt pool to extract a melt layer on the grooved surface, the melt layer directly contacting the land regions and substantially spanning each groove between adjacent land surfaces, providing an uncooled cylindrical top roll adjacent the exit of the melt layer from the pool with the axis of rotation of the top roll substantially parallel to the axis of rotation of the chill wheel and having its outer substantially cylindrical surface in spaced relation to the cylindrical surface of the chill wheel to define a gap therebetween corresponding to the thickness of the metal strip to be cast, adjusting the gap so that the top roll contacts only the molten metal above the solidifying strip whereby the strip is not pressed into the grooves on the chill surface, rotating the top roll to smooth the top surface of the strip and provide gauge control for the strip, and withdrawing heat from the melt layer through the grooved surface to progressively solidify the melt layer from the grooved surface to the melt layer top surface.

14. The process defined in claim 13 including rotating the top roll in opposite directions about spaced parallel axes at rates to produce substantially equal surface speeds.

15. The process defined in claim 14 wherein said groove density is within the range of about 15 to about 25 grooves per centimeter.

16. The process defined in claim 15 wherein the ratio of the width of said lands to said grooves is within the range of about 0.15 to about 0.75.

17. The process defined in claim 16 wherein the step of grooving said cylindrical surface comprises forming a single generally V-shaped groove in a continuous helical pattern around said cylindrical surface by a machining or rolling operation.

18. The process defined in claim 17 including applying heat to the top roll from a source other than the molten metal being cast to maintain the top roll surface at a temperature which will not solidify the top surface of the molten metal on the moving chill surface.

19. The process defined in claim 18 including providing a top roll surface contoured to cooperate with the chill wheel surface to provide a substantially uniform gap therebetween across the full width of the strip being formed.

20. The process defined in claim 18 including providing a top roll surface contoured to cooperate with the chill wheel surface to provide a non-uniform gap therebetween across the full width of the strip being formed.

* * * * *